US005687531A

United States Patent [19]

Nelson et al.

[11] Patent Number: 5,687,531

[45] Date of Patent: Nov. 18, 1997

[54] HORIZONTAL FLUE TECHNOLOGY FOR CARBON BAKING FURNACE

[75] Inventors: Bryan R. Nelson, Miffinburg, Pa.; En-Sheng Chen, Spring, Tex.

[73] Assignee: North American Refractories Company, State College, Pa.

[21] Appl. No.: 388,753

[22] Filed: Feb. 14, 1995

[51] Int. Cl.[6] ..... E04C 1/10

[52] U.S. Cl. ..... 52/596.1; 110/338; 52/603; 52/604; 52/605; 52/606; 52/607; 52/608; 52/609

[58] Field of Search ..... 52/596.1, 603–609; 110/184, 338

[56] References Cited

U.S. PATENT DOCUMENTS

| | | | |
|---|---|---|---|
| 986,132 | 3/1911 | Burlhartz | 52/604 |
| 2,141,035 | 12/1938 | Daniels | 52/604 X |
| 2,205,404 | 6/1940 | Fuller | 52/605 X |
| 2,241,169 | 5/1941 | Yokes | 52/606 X |
| 3,578,300 | 5/1971 | Goodrich . | |
| 3,614,446 | 10/1971 | Leuthold | 52/608 X |
| 3,895,906 | 7/1975 | Kottmeler . | |
| 4,152,107 | 5/1979 | Bernstein et al. . | |
| 4,239,600 | 12/1980 | Edgar . | |
| 4,256,454 | 3/1981 | Wiersma . | |
| 4,320,612 | 3/1982 | Jeffries, Jr. | 110/338 X |
| 4,372,091 | 2/1983 | Brown et al. | 52/604 X |
| 4,574,774 | 3/1986 | Wells . | |
| 4,698,949 | 10/1987 | Dietrich | 52/596 X |
| 4,803,933 | 2/1989 | Carey, Jr. et al. | 110/338 |
| 5,107,798 | 4/1992 | Gerep . | |
| 5,227,106 | 7/1993 | Kolvek . | |
| 5,228,955 | 7/1993 | Westbrook, III . | |
| 5,239,945 | 8/1993 | McCoy . | |
| 5,282,700 | 2/1994 | Rodrique | 52/609 X |
| 5,361,557 | 11/1994 | Snyder et al. | 52/604 X |
| 5,457,926 | 10/1995 | Jensen | 52/604 |

*Primary Examiner*—Wynn E. Wood

*Attorney, Agent, or Firm*—Benesch, Friedlander, Coplan & Aronoff LLP

[57] ABSTRACT

The present invention relates to specially shaped structural components for use in the construction of furnaces, foundries, and similar applications. In particular, the present invention relates to an improved flue wall in a high temperature furnace. The improved flue wall is constructed of specially shaped bricks to improve the tensile strength of the wall, increase the shear transfer capacity of the wall, and thus improve the flue wall life. The flue wall is constructed of specially designed refractory bricks joined together by air and/or heat-set mortar and arranged in courses, and comprises two parallel face walls parallel to the chambers wherein the carbon blocks are positioned and enclosing a flue chamber, two side walls generally perpendicular to the face walls enclosing the lower portion of the flue chamber, and baffle bricks and tie bricks arranged in a number of noncontinuous columns throughout the flue wall. In general the flue wall comprises H-shaped bricks used in the construction of the face walls, K-shaped bricks or C-shaped bricks used in the construction of the side walls of the flue wall to integrate the side wall with the first column of tie bricks, and I-shaped bricks used in the first column of baffle bricks and second column of tie bricks.

18 Claims, 6 Drawing Sheets

HORIZONTAL FLUE TECHNOLOGY FOR CARBON BAKING FURNACE

FIELD OF THE INVENTION

The present invention relates to specially shaped construction components having unique geometries for use in the construction of structures used in extreme environments, for example, furnaces, foundries, and similar structures. Additionally, the present invention relates to an improved flue wall for high temperature furnaces. The improved flue wall is constructed of specially shaped bricks to improve the tensile strength of the wall, increase the shear transfer capacity of the wall, and thus improve the flue wall life.

BACKGROUND OF THE INVENTION

High temperature furnaces and similar structures are known in the prior art. In general, these furnaces comprise a shell having vertical head walls spaced throughout the shell in parallel rows. These head walls are connected to and support several horizontal flue walls stacked vertically. There is a chamber between each successive flue wall for carbon blocks to be positioned to be baked. Internal combustion provides an indirect heat source to bake the carbon blocks outside the flue wall via suitable gas flow through the horizontal flue walls.

The flue wall is a double wall design. It consists of a flue chamber enclosed by two parallel face walls. For the desired heat flow and temperature distribution, intermediate baffles and tie bricks are used. The baffle bricks and tie bricks are arranged in noncontinuous columns throughout the flue wall. Two ends of the wall are closed in their lower portions with two side walls. The face walls, side walls, baffles, and tie bricks are composed of a number of brick shapes, joined together by air and/or heat-set mortars. In the walls of the prior art, the upper and lower faces of each brick are built with a tongue and groove design for the wall integrity.

One problem of flue walls of the prior art is that the flue wall is relatively thin compared to the axial dimension of the wall. Without proper bracing, the bending rigidity of the wall is low and the out-of-plane flexural deformation is likely to occur due to differential pressure from the carbon block expansion due to the heating of the carbon blocks and differences in packing between flue walls. This can result in various unfavorable conditions such as bulging deformation, mortar shear-off, opening of brick joints, and certain thermal expansion-induced problems.

Another problem concerning the flue walls of the prior art is that the expansion of the carbon blocks can create pressures to the adjacent face walls. Because of the random nature of the material properties and of the operation, along with confinement from the furnace shells, differential pressure can develop from one face wall to another face wall of the same flue wall. The shear forces due to the pressure are expected to be high near the two ends and the bending moments peak near the central portion of the flue wall. The pressure can be sufficient enough to deform the wall in the lateral direction to a significant level.

Another problem with the flue walls of the prior art is that they have poor shear rigidity near the two ends and further, the shear transfer throughout the wall is weak. Additionally, the use of mortar joints results in a low bonding strength between bricks of two adjacent courses. Upon a bending moment, one face wall has to take tensile stresses while another takes compressive stresses. The tensile stresses have to transfer from brick to brick through mortar joints by shear. Because of the low shear and bonding strength of the mortars, the joints can easily get sheared off and the bricks become loose in the axial direction. Thus, the bricks cannot transfer tensile stresses in the axial direction and the global bending rigidity is reduced. Additional damages can easily accumulate from additional heating cycles with the bulging and expansion allowance problems discussed above further deteriorating the flue wall integrity.

U.S. Pat. No. 5,228,955 discloses a coke oven wall, having extending gas flues formed within the coke oven walls. In this patent, the problems associated with flue walls are partially resolved by constructing the wall with alternative courses for the portion of wall surrounding the flue openings. Further, each course is defined by bricks of two different shapes to provide improved strength and gas tight integrity. However, in order to achieve higher thermomechanical performance of the flue wall and improve the service life of the flue wall, additional improvements are necessary.

It is desirable to make improvements to horizontal flue technology to improve the tensile strength of the flue wall, improve the global bending rigidity of the wall, increase the shear transfer capacity of the wall, and improve the service life of the wall.

SUMMARY OF THE INVENTION

In accordance with the present invention, there is provided specially shaped construction components having unique geometries for use in the construction of structures used in extreme environments, for example, furnaces, flue walls, ladles, and similar structures.

Further, in accordance with the present invention, an improvement in the flue wall construction for high temperature furnaces is provided to improve the performance of the flue wall and the service life of the flue wall.

Further in accordance with the present invention, an improvement in a flue wall design is provided for improving the tensile strength of the two parallel face walls that comprise the flue wall.

Still further in accordance with the present invention, an improvement in the flue wall design is provided for improving the global bending rigidity of the flue wall.

Still further in accordance with the present invention, an improved flue wall design is provided which increases the shear transfer capacity near the ends of the flue wall.

Still further in accordance with the present invention, an improved flue wall design is provided which minimizes the material used in redundant areas of the flue wall.

Still further in accordance with the present invention, a refractory brick design is provided having improved thermomechanical properties.

Still further in accordance with the present invention, construction components having unique geometries are provided for use in the construction of structures requiring special mechanical and thermal properties.

Generally, there is provided novel brick designs for structures such as flue walls requiring high degrees of structural integrity and thermomechanical strengths. Additionally, there is provided an improved flue wall for a high temperature furnace. The flue wall is constructed of specially designed refractory bricks joined together by air and/or heat-set mortars and arranged in courses, and comprises two parallel face walls parallel to the chambers wherein the carbon blocks are positioned and enclosing a flue chamber, two side walls generally perpendicular to the face walls enclosing the lower portion of the flue chamber, and baffle bricks and tie bricks arranged in a number of noncontinuous columns throughout the flue wall. In general, the following novel brick designs are provided:

a) refractory bricks having two opposing face surfaces, two opposing side surfaces perpendicular to the face surfaces, two opposing end surfaces perpendicular to the face surfaces and the side surfaces, the side surfaces having keys built into the surface resulting in a generally H-shaped brick, the bricks preferably being used in the construction of the face walls of flues for high temperature furnaces;

b) refractory bricks having two opposing face surfaces, the face surfaces having grooves on three sides of the face surface running the length of the brick, two opposing side surfaces perpendicular to the face surfaces, two opposing end surfaces perpendicular to the face surfaces and the side surfaces, three passageways through the brick running from one face surface to the other face surface, two of the passageways being triangular in shape and having one side of the triangle parallel to the side surfaces and one side of the triangle parallel to the end surfaces, the third passageway being four sided and having two sides of the passageway parallel to the side surfaces, the passageways being spaced a distance from the side surfaces and end surfaces and from the other passageways, the passageways resulting in a generally K-shaped brick, the bricks preferably being used in the construction of the side walls to integrate the side wall with the first column of tie bricks of flue walls for high temperature furnaces;

c) refractory bricks having two opposing rectangular end sections, the end sections having approximately the same proportions and a central section perpendicular to the end sections and connecting the end sections; each end section having two opposing face surfaces, two opposing end surfaces perpendicular to the face surfaces, and two opposing side surfaces perpendicular to the face surfaces and end surfaces and the side surface adjacent to the central section further comprises a side of the central section, the face surfaces having a groove running parallel to the end surfaces; the central section having two opposing face surfaces, the face surface being wider near the end sections than at the center of the central section, two opposing end surfaces each of which are a side surface of the end sections, and two side surfaces which are perpendicular to the face surfaces, one of said side surfaces being rounded inward toward the opposite side surface, and the face surface having a groove near the side opposite the rounded side and running parallel to the side surface, and said bricks being generally C-shaped, the bricks preferably being used in the construction of the side walls to integrate the side wall with the first column of tie bricks of flue walls for high temperature furnaces;

d) refractory bricks having two opposing rectangular end sections, the end sections having approximately the same proportions and a central section perpendicular to the end sections and connecting the end sections; each end section having two opposing face surfaces, two opposing end surfaces perpendicular to the face surfaces, and two opposing side surfaces perpendicular to the face surfaces and end surfaces and the side surface adjacent to the central section further comprises a side of the central section, wherein the face surfaces of the end sections have a two raised portions having grooves near the end surfaces, the face surfaces further having a tongue running parallel to the side surfaces; the central section having two opposing face surfaces, the face surface being wider near the end sections than at the center of the central section and each face surface having a groove running parallel to the end sections, two side surfaces parallel to the face surfaces, and two opposing end surfaces each of which are a side surface of the end sections, and said bricks being generally I-shaped, the bricks preferably being used in the first column of baffle bricks and second column of tie bricks of flue walls for high temperature furnaces.

These and other aspects of the invention will become clear to those skilled in the art upon the reading and understanding of the specification.

BRIEF DESCRIPTION OF THE DRAWINGS

The invention will be further described in connection with the attached drawing figures showing preferred embodiments of the invention including specific parts and arrangements of parts. It is intended that the drawings included as a part of this specification be illustrative of the preferred embodiment of the invention and should in no way be considered as a limitation on the scope of the invention.

DETAILED DESCRIPTION OF THE PREFERRED EMBODIMENT

This invention is directed to specially shaped construction components having unique geometries for use in the construction of structures for extreme environments, for example, furnaces, ladles, and similar structures and the structures constructed from these components. The specially shaped structural components can be precast refractory concrete shapes, refractory bricks, or the like. In a most preferred embodiment, the components are refractory bricks and are used in the construction of flue walls for high temperature furnaces. The invention will be further described in accordance with the preferred embodiment.

In summary, high temperature furnaces comprise a shell having vertical head walls spaced throughout the shell in parallel rows. The head walls are connected to and support several horizontal flue walls stacked vertically. A chamber exists between successively stacked flue walls for carbon blocks to be placed to be baked.

Figure 1:
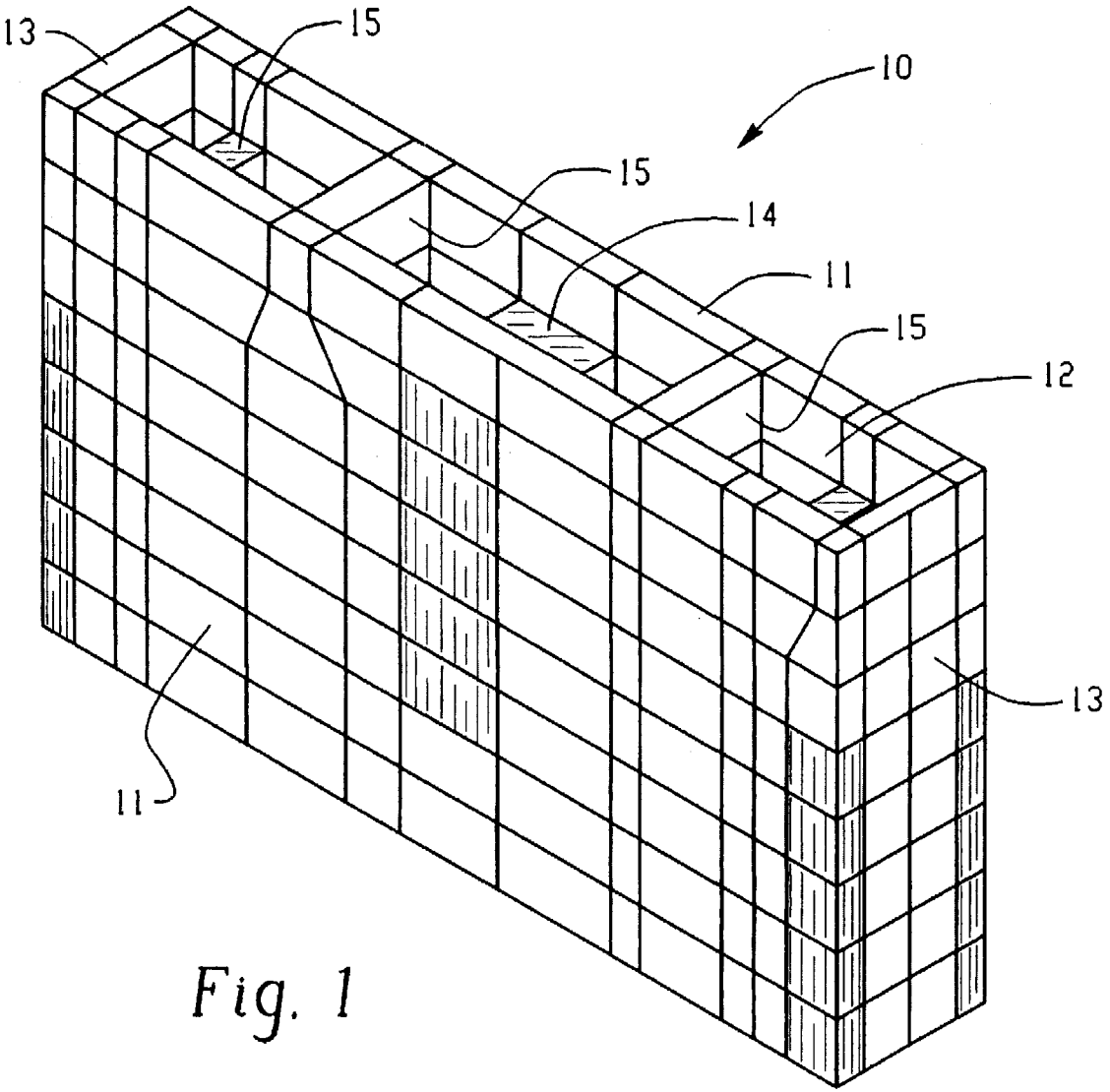
FIG. 1 is a perspective view of a symmetrical flue wall according to the present invention.

A symmetrical flue wall according to the present invention is shown in FIG. 1. The flue wall 10 is constructed from refractory bricks held together by air and/or heat-set mortar. The flue wall is a double wall design. It consist of two parallel face walls 11 which are parallel to the chamber wherein the carbon blocks are baked. The face walls enclose a flue chamber 12. The two ends of the face walls are closed in their lower portions by two side walls 13 generally perpendicular to the face walls. For desired heat flow and temperature distribution, baffle bricks and tie bricks are used in the flue wall. The baffle bricks 14 and tie bricks 15 are arranged in the flue wall in noncontinuous columns. The face walls, side walls, baffle bricks, and tie bricks are composed of a number of brick shapes. Preferably, the thickness of the flue wall is at least about 480 mm. In a most preferred embodiment the thickness of the flue wall is at least about 470 mm.

The refractory bricks of the invention are preferably derived from alumina refractory bricks. These bricks typically are comprised of alumina in the form of alumina oxide, silica, titania, iron oxide, lime, magnesia, and small amounts of alkalies. In a preferred embodiment, the refractory bricks of the flue wall are comprised of at least about 40% aluminum oxide.

Figure 2:
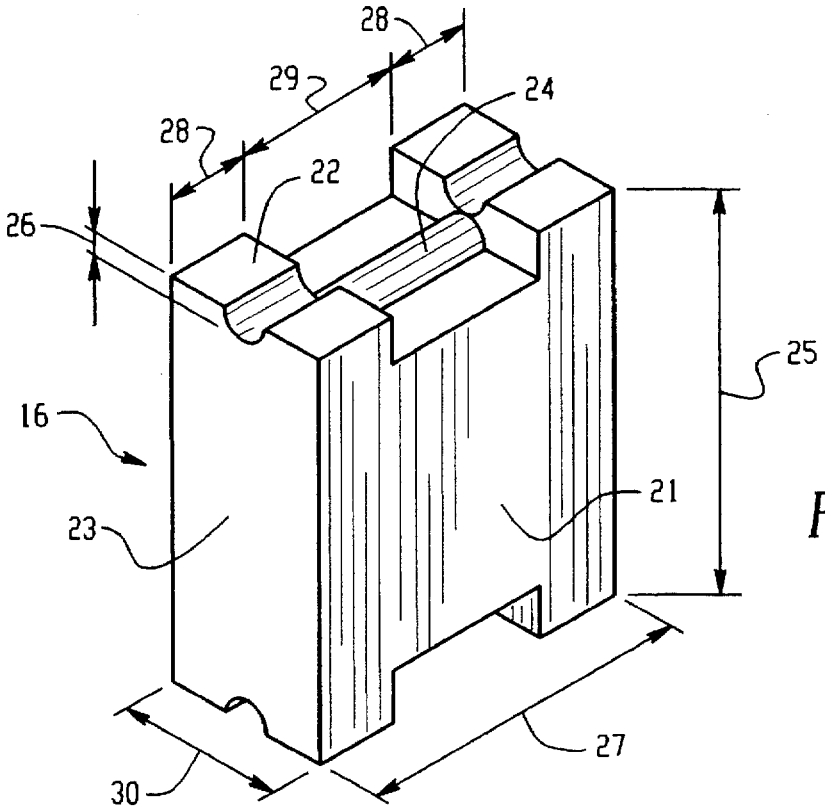
FIG. 2 is a perspective view of the H-shaped bricks according to the present invention.

The face walls 11 of the flue wall of the invention are comprised mainly of refractory bricks 16 shown in FIG. 2. These bricks have two opposing face surfaces 21, two opposing side surfaces 22 perpendicular to the face surfaces, and two opposing end surfaces 23 perpendicular to the face surfaces and the side surfaces. The side surfaces have keys 24 built into them and result in a generally H-shaped brick. Keys 24 include a convex-shaped tongue and a concave-shaped groove, as seen in FIG. 2. This brick will be referred to hereinafter as the H-shaped brick. The keys are located on the top and bottom faces of the brick when positioned in the face wall. With or without the keys, the tensile strength of the wall in its axial direction has to rely on the bending strength of the mortar between the bricks, which is not strong. Moreover, the keys are insufficiently strong to provide global bending rigidity. The H-shapes create a mechanical interlocking to bind the bricks together in the axial direction and provide better tensile strength upon global bending. This results in increased bending rigidity of the flue wall. Further, the H-shaped bricks are double the height of the bricks used in the face walls of flue walls of the prior art. This added height allows for the use of less mortar, which as discussed above is important to minimize, due to its low bond strength.

The dimensions of the H-shaped brick vary according to furnace chamber size and other factors. For purposes of illustration only, the H-shaped brick may have dimensions as described below. The height of the brick as indicated by 25 may be about 198 mm. The depth of the keys into the side surfaces as indicated by 26 may be about 25 mm. The length of the brick as indicated by 27 may be about 290 mm. The length of the legs of the H-shaped brick as indicated by 28 may be about 72 mm. The length of the area between the legs as indicated by 29 may be about 146 mm. The width of the brick as indicated by 30 may be about 94 mm.

Figure 3:
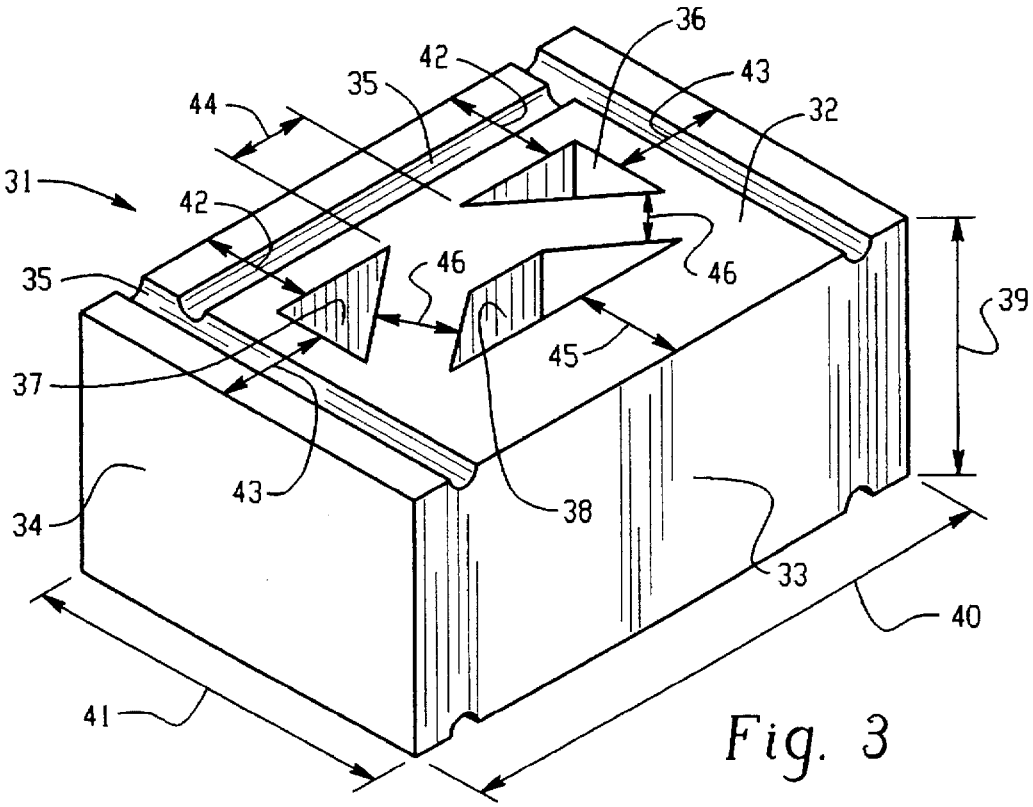
FIG. 3 is a perspective view of the K-shaped bricks according to the present invention.

In the flue wall of the invention, the tie bricks in the first column as counted from one of the side walls are integrated with the side wall. In one embodiment of the flue wall, the integrated side wall and tie bricks are the bricks 31 as shown in FIG. 3. These integrated side wall and tie bricks have two opposing face surfaces 32, two opposing side surfaces 33 perpendicular to the face surfaces, and two opposing end surfaces 34 perpendicular to the face surfaces and the side surfaces. The face surfaces have grooves 35 on three sides which run the length of the side. The bricks further comprise three passageways 36, 37, 38 through the brick running from one face surface to the other face surface. Two of the passageways 36, 37, have a triangular shape with one of the sides of the triangle parallel to the side surfaces and another side of the triangle parallel to the end surfaces of the brick. The third passageway 38 is four sided and two of the four sides are parallel to the side surfaces. The passageways are spaced a distance from the side surfaces and end surfaces. The passageways result in the brick being generally K-shaped. This brick will be referred to hereinafter as a K-shaped brick. These integrated side wall and tie bricks provide good shear rigidity near the two ends of the flue wall and improve shear transfer capacity without hindering the all critical flue glass flow, i.e. the reason for passageways. By using the K-shaped bricks, brick geometry is optimized as the K-shaped brick is capable of properly transferring stresses from the face walls to the side walls.

The dimensions of the K-shaped brick vary according to furnace chamber size and other factors. For purposes of illustration only, the K-shaped brick may have the dimensions as described below. The height of the brick as indicated by 39 may be about 198 mm. The length of the brick as indicated by 40 may be about 470 mm to about 480 mm. The width of the brick as indicated by 41 may be about 317 mm. The distance between the two triangular passageways, 36, 37 and the nearest side surface as indicated by 42 may be about 94 mm. The distance between the two triangular passageways and the nearest end surface as indicated by 43 may be about 94 mm. The distance between two triangular passageways as measured from the two corners of the passageways closest together as indicated by 44 may be about 94 mm. The distance from the four sided passageway 38 and the nearest side surface as indicated by 45 may be about 94 mm. The distance between the two triangular passageways and the four side passageway as indicated by 46 may be about 70 mm.

Figure 4:
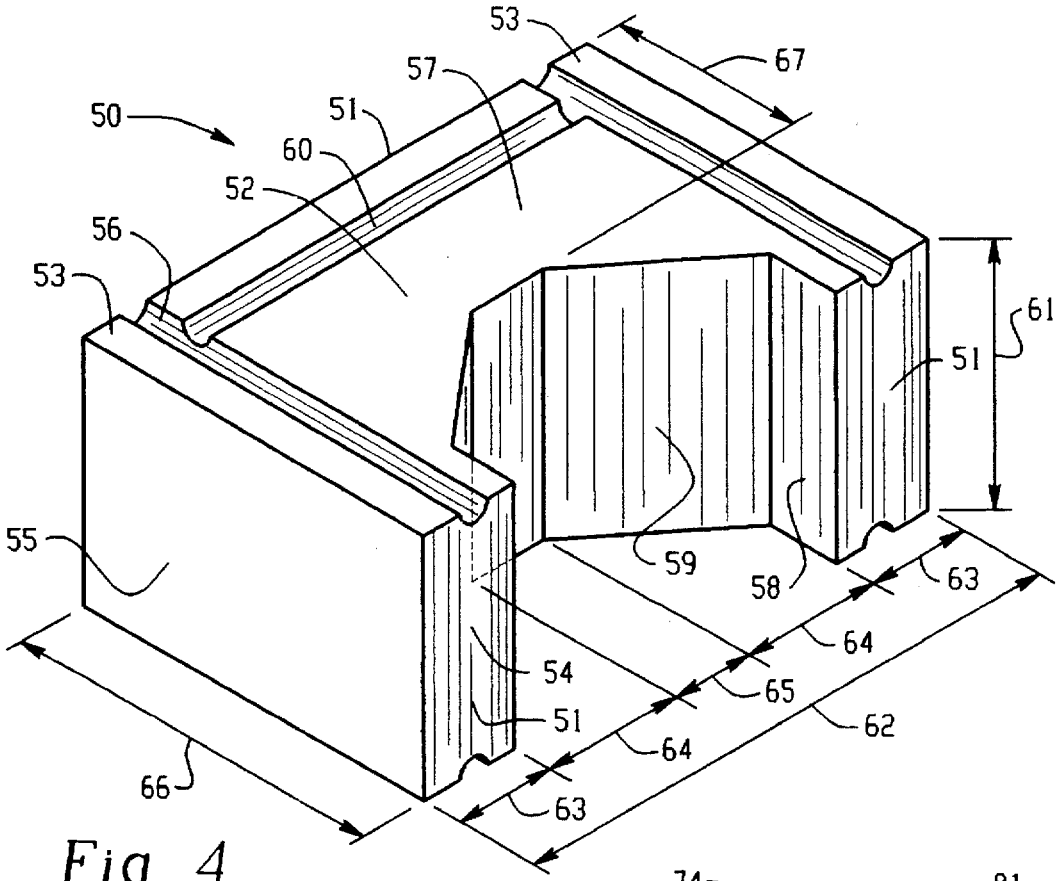
FIG. 4 is a perspective view of the C-shaped bricks according to the present invention.

In an another embodiment, the integrated side wall and tie bricks are the bricks 50 as shown in FIG. 4. These integrated side wall and tie bricks have two opposing end sections 51, the end sections having approximately the same proportions, and a central section 52 perpendicular to the end sections and connecting the end sections. Each end section has two opposing face surfaces 53, and two opposing end surfaces 54 perpendicular to the face surfaces, and two opposing side surfaces 55 perpendicular to the face surfaces and the end surfaces. The side surfaces of each end section adjacent to the central section is also one of the end surfaces of the central section. The face surfaces of the end sections have grooves 56 running the length of the brick parallel to the side surfaces. The central section also has two opposing face surfaces 57 with the face surfaces being wider near the end sections of the brick, two end surfaces 58 perpendicular to the face surfaces each of which are one side surface of the end sections, and two side surfaces 59 perpendicular to the face surfaces. One of the side surfaces is rounded inward toward the opposite side surface. The face surface have a groove 60 near the side opposite the rounded side and running parallel to the side surface. These bricks are generally C-shaped and will be hereinafter referred to as C-shaped bricks. As with the K-shaped bricks, the C-bricks which are used as integrated side wall and tie bricks provide good shear rigidity near the two ends of the flue wall and improve shear transfer capacity without hindering the all critical flue glass flow. By using the C-shaped bricks, brick geometry is optimized as the C-shaped brick is capable of properly transferring stresses from the face walls to the side walls.

The dimensions of the C-shaped brick vary according to furnace chamber size and other factors. For purposes of illustration only, the C-shaped brick may have the dimensions as described below. The height of the C-shaped brick as indicated by 61 may be about 198 mm. The length of the bricks as indicated by 62 may be about 510 mm. The length of the end sections indicated by 63 may be about 100 mm. The length from the end section to the narrowest part of the central section as indicated by 64 may be about 107 mm. The length of the narrowest portion of the central section as indicated by 65 may be about 96 mm. The width of the brick as indicated by 66 may be about 334 mm. The width of the narrowest part of the central portion as indicated by 67 may be about 200 mm.

Figure 5:
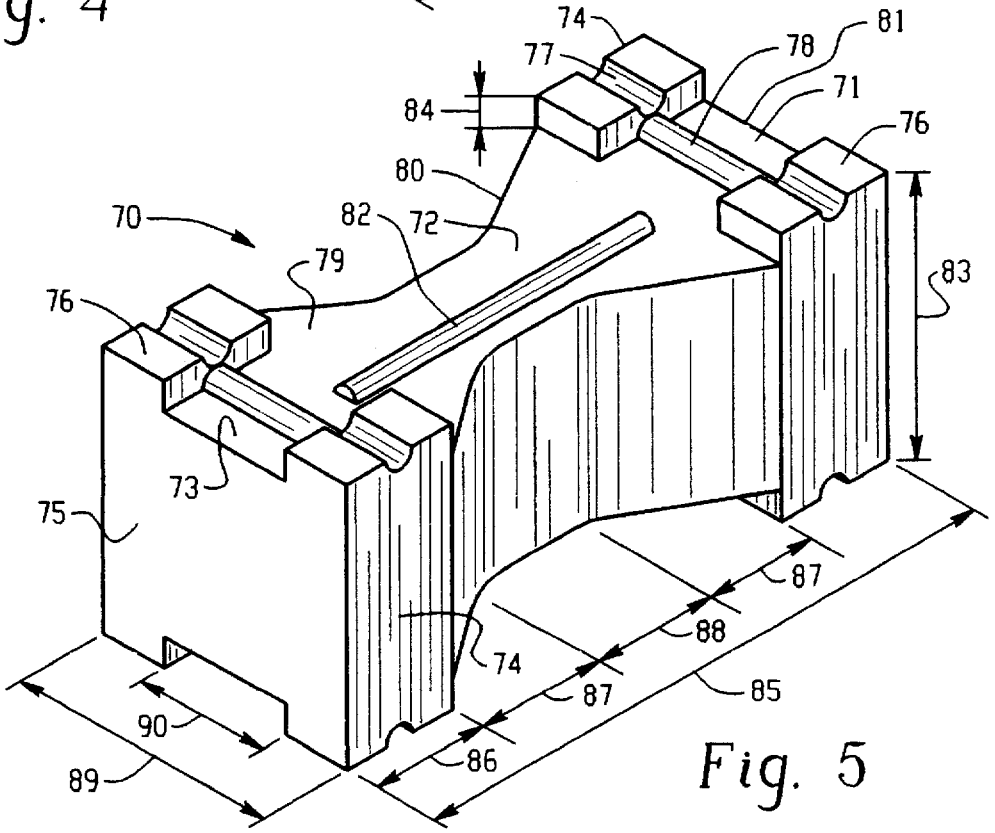
FIG. 5 is a perspective view of the I-shaped bricks according to the present invention.

The face walls further are comprised of additional columns of tie bricks and columns of baffle bricks. The second column of tie bricks and the first column of baffle bricks comprise refractory bricks 70 as shown in FIG. 5. These bricks have two opposing end sections 71, the end sections having approximately the same proportions, and a central section 72 perpendicular to the end sections and connecting the end sections. Each end section has two opposing face surfaces 73, and two opposing end surfaces 74 perpendicular to the face surfaces, and two opposing side surfaces 75 perpendicular to the face surfaces and the end surfaces. The side surfaces of each end section adjacent to the central section is also one of the end surfaces of the central section. The face surfaces of the end sections have two raised portions 76 near the end surfaces and these raised portions have grooves 77 running parallel to the side surfaces. The face surfaces further have a tongue 78 running parallel to the side surfaces between the two raised portions. The central section also has two opposing face surfaces 79 with the face surfaces being wider near the end sections of the brick, two side surfaces 80 perpendicular to the face surfaces and two end surfaces 81 each of which are one side surface of the end sections. The face surfaces of the central section have a groove 82 running perpendicular to the end sections and running part of the length of the central section. These bricks are generally I-shaped and will be hereinafter referred to as I-shaped bricks. The baffle bricks in the center column are also I-shaped. These bricks bridge a face wall to the opposite face wall. The design of the I-shaped brick provides good bracing capacity and improves the shear transfer capability of the wall. In one embodiment, the flue wall contains at least one continuous baffle column comprised of I-shaped bricks.

The dimensions of the I-shaped brick vary according to furnace chamber size and other factors. For purposes of illustration only, the I-shaped brick may have the dimensions as described below. The height of the I-shaped brick as indicated by 83 may be about 198 mm. The height of the raised portion of the end section as indicated by 84 may be about 25 mm. The length of the bricks as indicated by 85 may be about 480 mm. The length of the end sections indicated by 86 may be about 94 mm. The length from the end section to the narrowest part of the central section as indicated by 87 may be about 100 mm. The length of the narrowest portion of the central section as indicated by 88 may be about 92 mm. The width of the brick as indicated by 89 may be about 92 mm. The width of the narrowest part of the central portion as indicated by 90 may be about 146 mm.

Figure 6:
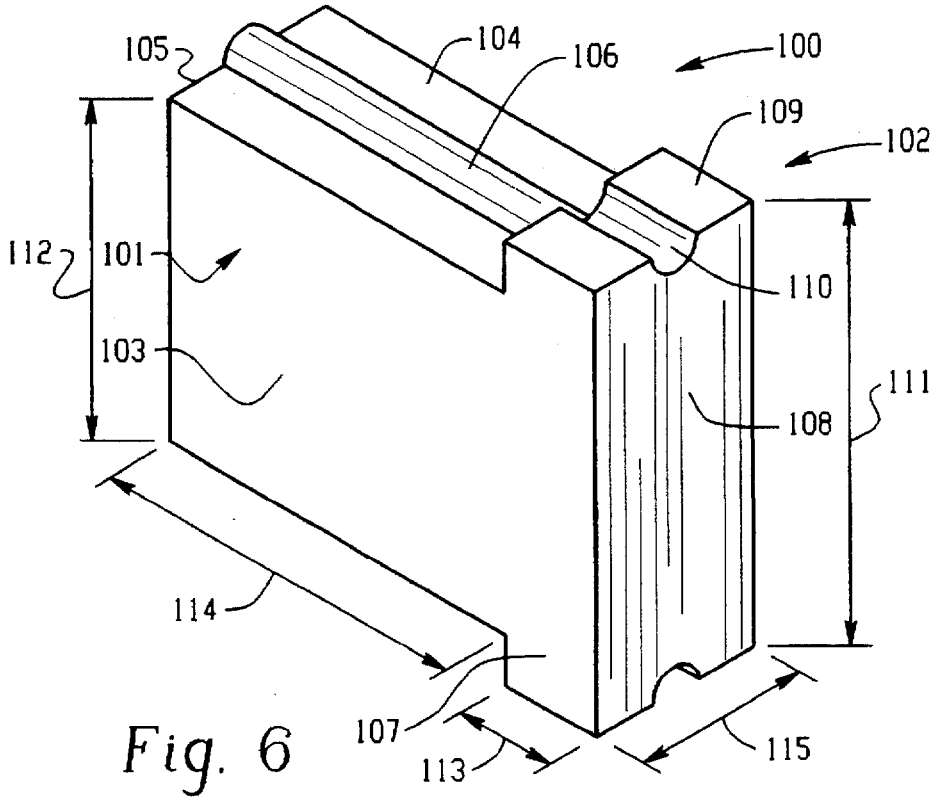
FIG. 6 is a perspective view of the T-shaped bricks according to the present invention.

In the invention the face wall can be comprised of other shapes of bricks in addition to the H-shaped bricks and the I-shaped baffle bricks and tie bricks. The face wall can be comprised of bricks 100 as shown in FIG. 6 having a first rectangular section 101 connected to a second rectangular section 102 in such a way to form a T-shaped brick. This brick will hereinafter be referred to as a T-shaped brick. The first rectangular section will be referred to as the leg section and the second rectangular section will be referred to as the cross section. The leg section has two opposing face surfaces 103 two opposing side surfaces 104 perpendicular to the face surfaces, and two opposing end surfaces 105 perpendicular to the face surfaces. The side surfaces have tongues 106 running the length of the side surface. The cross section has two opposing face surfaces, 107, two opposing side surfaces 108 perpendicular to the face surfaces, and two opposing end surfaces 109 perpendicular to the face surfaces. The side surface adjacent to leg section further comprise part of the end surface of the leg section adjacent to the cross section. The end surfaces have a groove 110 running the length of the end surface. The bricks are positioned in the face wall in such a way that the T shape is on its side.

The dimensions of the T-shaped bricks vary according to furnace chamber size and other factors. For purposes of illustration only, the T-shaped bricks may have the dimensions as described below. In a preferred embodiment, there are two different sizes of T-shaped bricks used in the face. Regarding the dimensions of the first T-shaped brick, the height of the cross section as indicated by 111 may be about 198 mm. The height of the leg section as indicated by 112 may be about 148 mm. The length of the cross section of the T-shape as indicated by 113 may be about 72 mm. The length of the leg section as indicated by 114 may be about 295 mm. The width of the brick as indicated by 115 may be about 198 mm. Concerning, the dimensions of the second T-shaped brick, the height of the cross section as indicated by 111 may be about 198 mm. The height of the leg section as indicated by 112 may be about 148 mm. The length of the cross section of the T-shape as indicated by 113 may be about 72 mm. The length of the leg section as indicated by 114 may be about 146 mm. The width of the brick as indicated by 115 may be about 94 mm.

Figure 7:
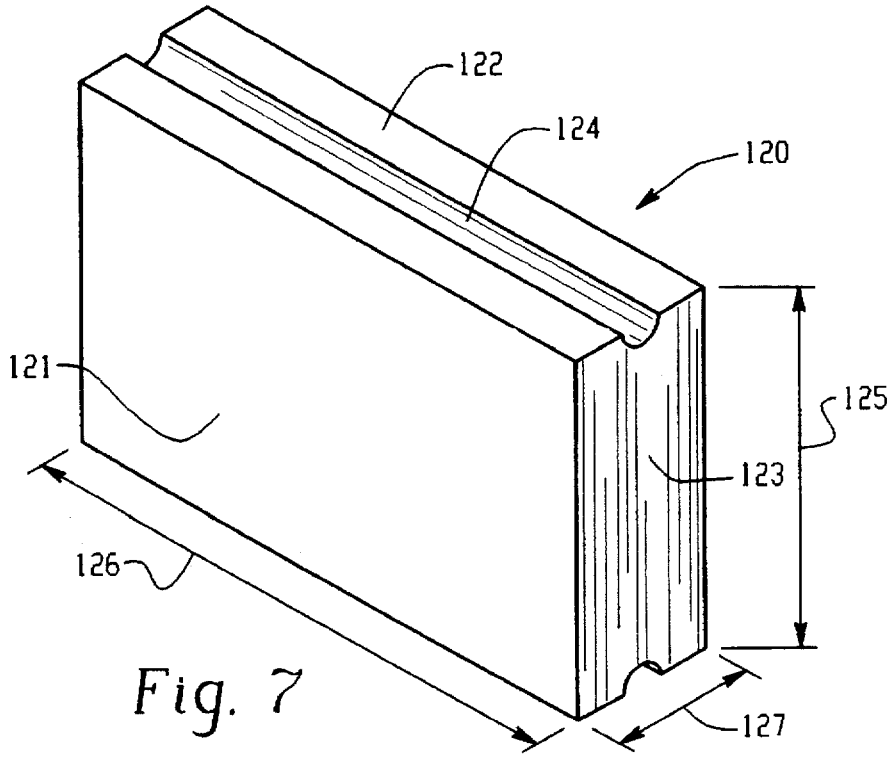
FIG. 7 is a perspective view of one design of rectangular bricks according to the present invention.

The face walls can also comprise bricks 120 having a rectangular shape as shown in FIG. 7. These bricks are rectangular in shape having two opposing face surfaces 121, two opposing side surfaces 122 perpendicular to the face surfaces and two opposing end surfaces 123 perpendicular to the face surfaces. The side surfaces having a groove 124 running the length of the brick. The groove is on the top and bottom faces of the brick when positioned in the face wall.

The dimensions of the rectangular bricks vary according to furnace chamber size and other factors. For purposes of illustration only, the rectangular bricks may have the dimensions as described below. In a preferred embodiment, there are two different sizes of rectangular shaped bricks used in the face wall. Regarding dimensions of the first rectangular shaped brick, the height of the brick as indicated by 125 may be about 198 mm. The length of the brick as indicated by 126 may be about 317 mm. The width of the brick as indicated by 127 may be about 94 mm. Concerning the dimensions of the second rectangular shaped brick, the height of the brick as indicated by 125 may be about 148 mm. The length of the brick as indicated by 126 may be about 243 mm. The width of the brick as indicated by 127 may be about 94 mm.

In addition to forming part of the face wall, the bricks as shown in FIG. 7 may also be used to work in conjunction with I-shaped bricks to form baffles. For this function, these rectangular bricks are used in the third column of the tie bricks and are positioned in the face wall to bridge the face walls.

The dimensions of the rectangular brick vary according to furnace chamber size and other factors. For purposes of illustration only, these rectangular brick may have the dimensions as described below. The height of rectangular shaped tie bricks as indicated by 125 may be about 198 mm. The length of the bricks as indicated by 126 may be about 280 mm. The width of the bricks as indicated by 127 may be about 280 mm.

Figure 8:
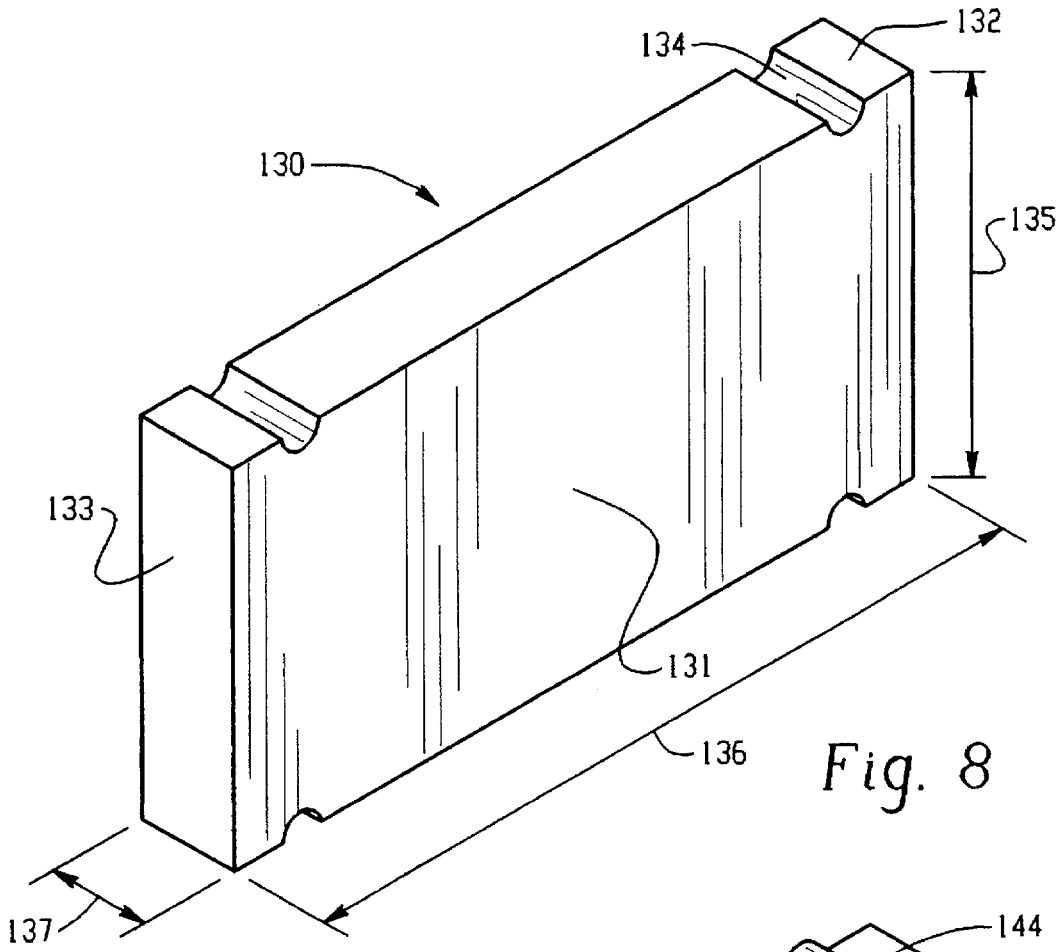
FIG. 8 is a perspective view of a second design of rectangular shaped bricks according to the present invention.

The face walls can also comprise a second rectangular shaped brick 130 shown in FIG. 8. The brick has two opposing face surfaces 131, two opposing side surfaces 132 perpendicular to the face surfaces, and two opposing end surfaces perpendicular 133 to the face surfaces. The side surfaces have two grooves 134 near the end surfaces running the width of the brick. The grooves 134 are located on the top and bottom faces of the brick when positioned in the face wall.

The dimensions of the rectangular brick vary according to furnace chamber size and other factors. For purposes of illustration only, the rectangular brick can have the dimensions described above. The height of this fourth rectangular shaped brick as indicated by 135 may be about 198 mm. The length of the brick as indicated by 136 may be about 470 mm. The width of the brick as indicated by 137 may be about 72 mm.

Figure 9:
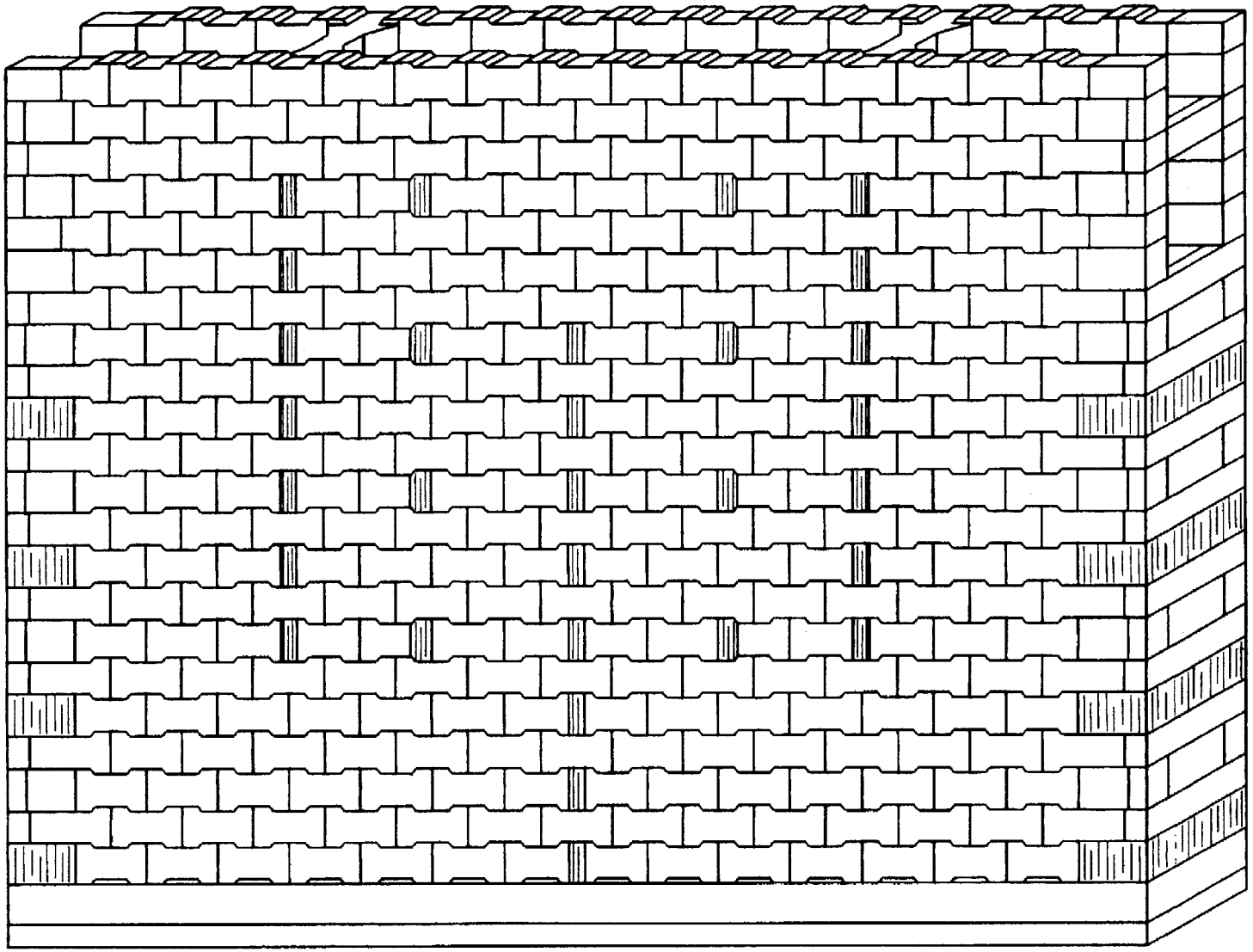
FIG. 9 is a perspective view of the flue wall showing the arrangement of the bricks used in the construction of the flue wall.

The arrangement of the many brick shapes which can comprise the face walls is shown in FIG. 9.

In the invention, the side walls can be comprised of other shaped bricks in addition to the K-shaped integrated side wall and tie bricks. The side walls can be comprised of rectangular shaped bricks. These bricks 120 are also used in the face wall and are shown in FIG. 7. The brick has two opposing face surfaces 121, two opposing side surfaces 122 perpendicular to the face surfaces and two opposing end surfaces 123 perpendicular to the face surfaces. The side surfaces have a groove 124 running the length of the brick. The grooves 124 are located on the tops and bottom sides of the brick when positioned in the side wall.

The dimensions of the rectangular brick vary according to furnace chamber size and other factors. For purposes of illustration only, the rectangular brick may have the dimensions as described below. The height of the rectangular shaped brick as indicated by 125 may be about 198 mm. The length of the brick as indicated by 126 may be about 280 mm. The width of the brick as indicated by 127 may be about 126 mm.

Figure 10:
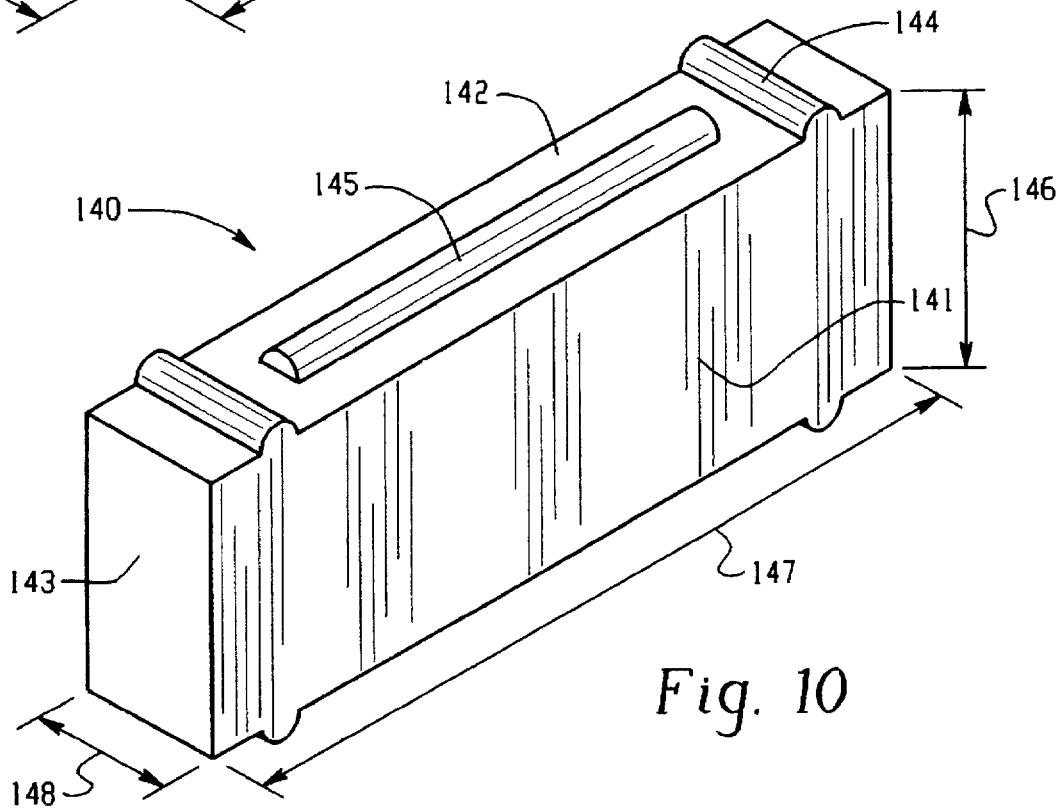
FIG. 10 is a perspective view of a third design of rectangular shaped bricks according to the present invention.

The side walls can further comprise additional rectangular shaped bricks 140 as shown in FIG. 10. The bricks have two opposing face surfaces 141, two opposing side faces 142 perpendicular to the face surfaces, and two opposing end surfaces 143, perpendicular to the face surfaces and the side surfaces. The side surfaces have two tongues 144 near the end surfaces and these tongues run the width of the brick. The side surfaces further have one tongue 145 which runs between the two tongues.

The dimensions of the rectangular brick can vary according to furnace chamber site and other factors. For purposes of illustration only, the rectangular brick can have the dimensions described below. The height of the rectangular brick as indicated by 146 may be about 148 mm. The length of the brick as indicated by 147 may be about 470 mm to about 480 mm. The width of the brick as indicated by 148 may be about 94 mm.

The arrangement of the shapes of bricks which can comprise the side walls is shown in FIG. 9.

The specially shaped construction components and specifically bricks according to the present invention may also be prepared from such compositions as precast concretes and thus are not limited to being formed from refractory compositions.

Although various exemplary embodiments of the invention have been disclosed for illustrative purposes, it is understood that variations and modifications can be made by one skilled in the art without departing from the spirit or scope of the invention.

What we claim:

1. A specially shaped construction component having a unique geometry for constructing dimensionally stable structures wherein said component comprises two opposing side surfaces, two opposing H-shaped face surfaces perpendicular to said side surfaces and forming a recess in each of said side surfaces, two opposing end surfaces perpendicular to said side surfaces and said face surfaces, each said side surface having keys projecting therefrom, the keys including at least one tongue and at least one groove.

2. A specially shaped construction component according to claim 1, wherein said tongue is formed in said recess.

3. A specially shaped construction component according to claim 1, where in said groove is formed in said recess.

4. A specially shaped construction component according to claim 1, wherein said tongue has a convex surface and said groove has a concave surface.

5. A specially shaped construction component according to claim 1, wherein said face surfaces are uninterrupted.

6. A solid refractory brick for use in structures for high temperature environments, said brick comprising two opposing H-shaped face surfaces, two opposing side surfaces perpendicular to said face surfaces, said face surface each forming a recess in each of said surfaces, two opposing end surfaces perpendicular to said face surfaces and side surfaces, each said side surface having keys projecting therefrom, the keys including at least one tongue and at least one groove.

7. The refractory brick of claim 6 wherein said brick is used in the construction of a flue wall for a high temperature furnace, said flue wall having two parallel face walls enclosing a flue chamber, two side walls generally perpendicular to said face walls enclosing the lower portion of said flue chamber, and baffle bricks and tie bricks arranged in non-continuous columns throughout the flue wall bridging said face walls, and wherein said refractory bricks are used in the construction of said face walls of said flue wall.

8. The refractory brick of claim 6 wherein said brick is an alumina refractory brick.

9. The refractory brick of claim 8 wherein said alumina refractory brick is comprised of about 40% to about 60% aluminum oxide.

10. A flue wall for a high temperature furnace having two parallel face walls enclosing a flue chamber, two side walls generally perpendicular to said face walls enclosing the lower portion of said flue chamber, and baffle bricks and tie bricks arranged in non-continuous columns throughout the flue wall bridging said face walls, comprising:

a) refractory bricks having two opposing face surfaces, two opposing side surfaces perpendicular to said face surfaces, two opposing end surfaces perpendicular to said face surfaces and side surfaces, said side surface having keys built into said surface and said bricks being used in the construction of said face walls of said flue wall; and b) refractory bricks having two opposing surfaces, two opposing side surfaces perpendicular to said face surfaces, two opposing end surfaces perpendicular to said face surfaces and side surfaces, said face surfaces having grooves on three sides running the length of the side, said brick further having three passageways through said brick running from one face surface to the other face surface, two of said passageways being triangular in shape and having one side of the triangle parallel to the side surfaces and another side of the triangle parallel to the end surfaces, the third passageway being four sided and having two of the sides parallel to said side surfaces, all of said passageways being spaced a distance from said side surfaces and end surfaces and from the other passageways and said bricks being used in the construction of said side walls to integrate said side wall into the first column of tie bricks.

11. The flue wall of claim 10 wherein said face surfaces of the refractory bricks as defined in (a) have the general shape of the letter H.

12. The flue wall of claim 10 wherein said face surfaces of the refractory bricks as defined in (b) have the general shape of the letter K.

13. The flue wall of claim 10 wherein said bricks used in the flue wall are alumina refractory bricks.

14. The flue wall of claim 10 wherein said alumina refractory bricks are comprised of about 40% to about 60% aluminum oxide.

15. The flue wall of claim 10 wherein the thickness of said flue wall is about 480 mm.

16. The flue wall of claim 10 wherein the thickness of said flue wall is about 470 mm.

17. The flue wall of claim 10 wherein said face walls further comprise bricks of additional shapes.

18. The flue wall of claim 10 wherein said side walls further comprise bricks of additional shapes.

* * * * *